US009839339B2

(12) United States Patent
Dries

(10) Patent No.: US 9,839,339 B2
(45) Date of Patent: Dec. 12, 2017

(54) FLUID CIRCULATION SYSTEM FOR DISHWASHER APPLIANCES

(71) Applicant: General Electric Company, Schenectady, NY (US)

(72) Inventor: John Edward Dries, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 338 days.

(21) Appl. No.: 14/595,281

(22) Filed: Jan. 13, 2015

(65) Prior Publication Data

US 2016/0198926 A1 Jul. 14, 2016

(51) Int. Cl.
*A47L 15/06* (2006.01)
*A47L 15/42* (2006.01)

(52) U.S. Cl.
CPC ..... *A47L 15/06* (2013.01); *A47L 15/4202* (2013.01)

(58) Field of Classification Search
None
See application file for complete search history.

(56) References Cited

U.S. PATENT DOCUMENTS

| | | | | |
|---|---|---|---|---|
| 2,808,063 | A | 10/1957 | Abresch et al. | |
| 3,108,606 | A | 10/1963 | Grunvogel | |
| 3,179,116 | A | 4/1965 | Jacobs | |
| 3,323,529 | A * | 6/1967 | Geiger | A47L 15/23 134/104.1 |
| 3,960,728 | A * | 6/1976 | Otzen | B01D 29/27 134/111 |
| 8,603,255 | B2 | 12/2013 | Classen et al. | |
| 2006/0151016 | A1 * | 7/2006 | Jeon | A47L 15/4204 134/111 |

* cited by examiner

*Primary Examiner* — Michael E Barr
*Assistant Examiner* — Cristi J Tate-Sims
(74) *Attorney, Agent, or Firm* — Dority & Manning, P.A.

(57) ABSTRACT

Fluid circulation systems for dishwasher appliances are provided. A dishwasher appliance includes a tub that defines a wash chamber. A fluid circulation system includes a sump for receiving fluid from the wash chamber, the sump comprising a chamber having a sidewall and a base wall. The fluid circulation system further includes a pump, the pump including an impeller disposed within the chamber. The fluid circulation system further includes a filter disposed within the chamber and surrounding the impeller, the filter including a sidewall, the sidewall defining a plurality of perforations extending therethrough. In some embodiments, a volume within the filter is greater than a volume between the sidewall of the chamber and the sidewall of the filter for a given height from the base wall. In some embodiments, volumes of the plurality of perforations increase along a height from the base wall.

18 Claims, 7 Drawing Sheets

FLUID CIRCULATION SYSTEM FOR DISHWASHER APPLIANCES

FIELD OF THE INVENTION

The subject matter of the present disclosure relates generally to dishwasher appliances, and more particularly to fluid circulation systems with improved filtration in dishwasher appliances.

BACKGROUND OF THE INVENTION

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

Dishwasher appliances further typically include a fluid circulation system which is in fluid communication with the spray assemblies for circulating fluid to the spray assemblies. The fluid circulation system generally receives fluid from the wash chamber, filters soil from the fluid, and flows the filtered fluid to the spray assemblies. Additionally, unfiltered fluid can be flowed to a drain as required.

Currently known fluid circulation systems utilize a large, flat, coarse filter and a cylindrical fine filter to filter soil. Each of these filters typically has constant filter hole, or perforation, sizes which are vulnerable to clogging during operation of the dishwasher appliance. Further, the constant filter hole sizes cannot respond to differences in soil conditions during operation.

Accordingly, improved fluid circulation systems for dishwasher appliances are desired. In particular, fluid circulation systems which provide improved fluid filtering would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a fluid circulation system for a dishwasher appliance is provided. The dishwasher appliance includes a tub that defines a wash chamber. The fluid circulation system includes a sump for receiving fluid from the wash chamber, the sump comprising a chamber having a sidewall and a base wall. The fluid circulation system further includes a pump, the pump including an impeller disposed within the chamber. The fluid circulation system further includes a filter disposed within the chamber and surrounding the impeller, the filter including a sidewall, the sidewall defining a plurality of perforations extending therethrough. A volume within the filter is greater than a volume between the sidewall of the chamber and the sidewall of the filter for a given height from the base wall.

In accordance with another embodiment, a fluid circulation system for a dishwasher appliance is provided. The dishwasher appliance includes a tub that defines a wash chamber. The fluid circulation system includes a sump for receiving fluid from the wash chamber, the sump comprising a chamber having a sidewall and a base wall. The fluid circulation system further includes a pump, the pump including an impeller disposed within the chamber. The fluid circulation system further includes a filter disposed within the chamber and surrounding the impeller, the filter including a sidewall, the sidewall defining a plurality of perforations extending therethrough. Volumes of the plurality of perforations increase along a height from the base wall.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
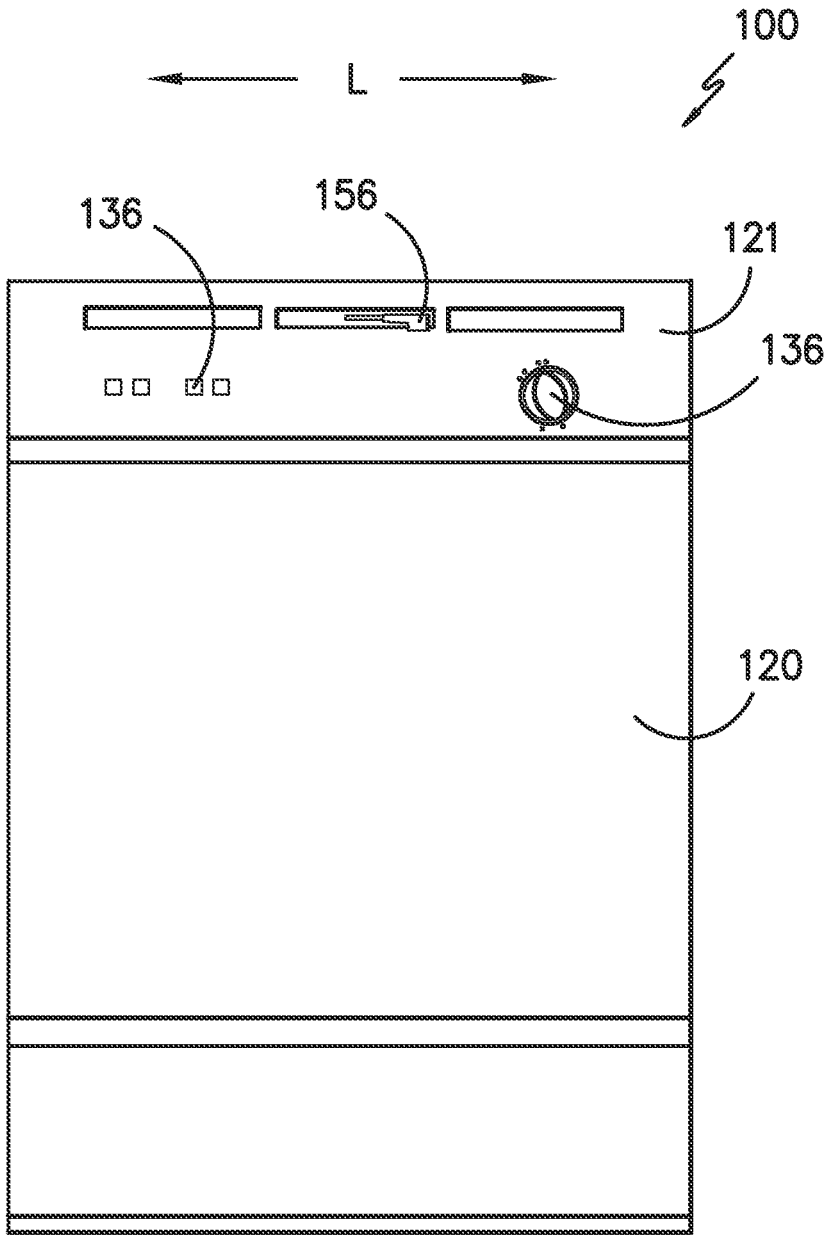
FIG. 1 provides a front view of an exemplary embodiment of a dishwasher appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
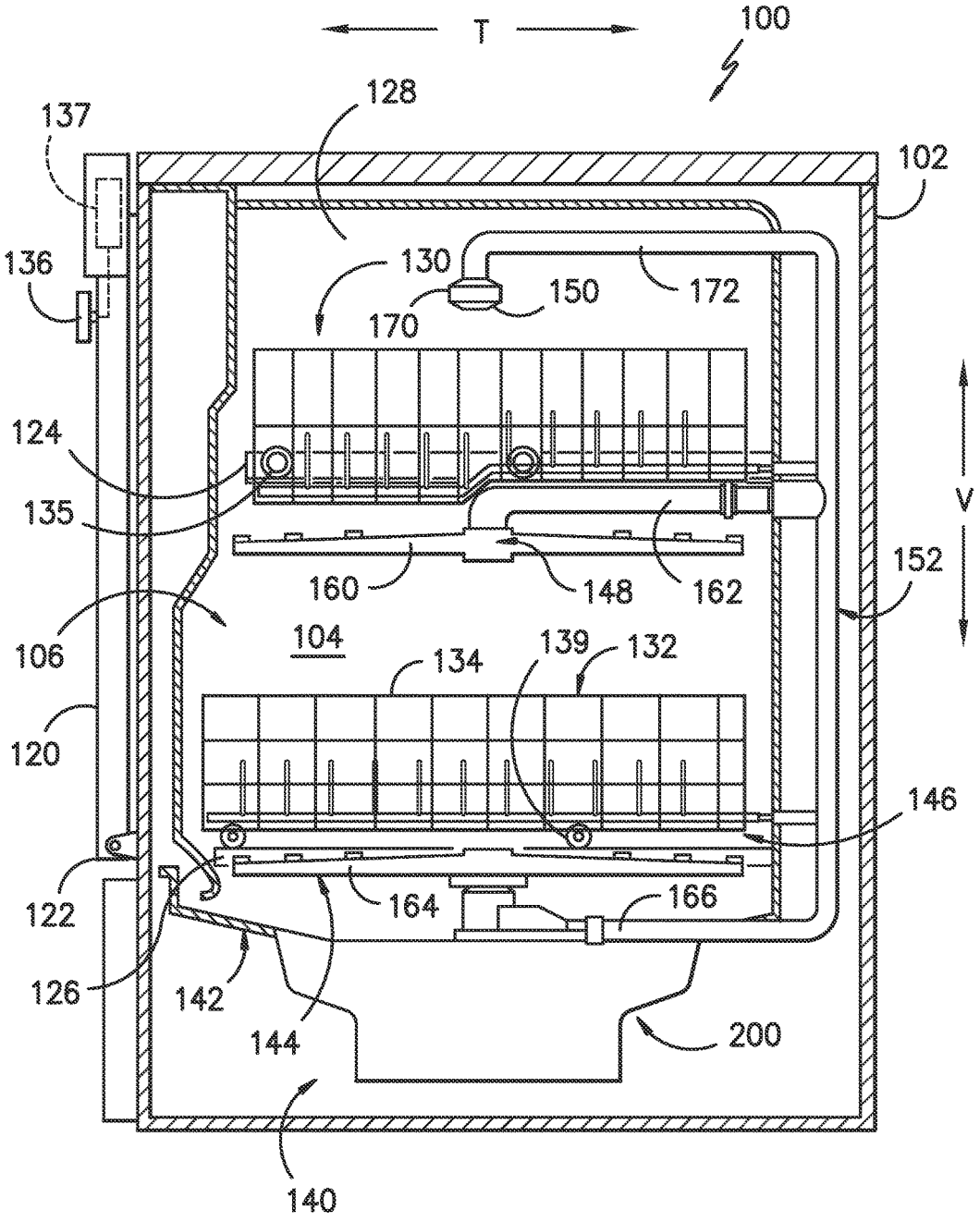
FIG. 2 provides a side, cross-sectional view of the exemplary dishwasher appliance of FIG. 1.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. As shown, the dishwasher appliance 100 (such as the cabinet 102 thereof) defines a vertical direction V, a lateral direction L, and a transverse direction T, which are mutually orthogonal and define a coordinate system for the dishwasher appliance. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. A latch 156 may be used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a bottom wall 142 of the tub 104 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

Each spray arm-assembly 144 may include a spray arm and a conduit in fluid communication with the spray arm, for providing a fluid flow to the spray arm. For example, mid-level spray-arm assembly 148 may include a spray arm 160 and a conduit 162. Lower spray-arm assembly 144 may include a spray arm 164 and a conduit 166. Additionally, upper spray assembly 150 may include a spray head 170 and a conduit 172 in fluid communication with the spray head 170.

The lower and mid-level spray-arm assemblies 144, 148 and the upper spray assembly 150 are part of a fluid circulation system 152 for circulating fluid in the dishwasher appliance 100. The fluid circulation system 152 also includes various components for receiving fluid from the wash chamber 106, filtering the fluid, and flowing the fluid to the various spray assemblies such as the lower and mid-level spray-arm assemblies 144, 148 and the upper spray assembly 150. As discussed herein such components can be generally positioned within a machinery compartment 140 below the bottom wall 142 and in communication with the wash chamber 106.

The dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different combinations of spray assemblies may be utilized, and other differences may be applied as well.

Referring now to FIGS. 3 through 7, various embodiments of portions of the fluid circulation system 152 of a dishwasher appliance 100 are illustrated. As shown, system 152 may include, for example, a sump 200 for receiving fluid from the wash chamber 106. The sump 200 may be mounted to the bottom wall 142 and extend into the machinery compartment 140, and fluid may for example flow from the bottom wall 142 into the sump 200.

Sump 200 may include, for example, a chamber 202 which receives the fluid from the wash chamber 106. Sump 200 may additionally include a receptacle 204 which may, for example, receive the fluid from the wash chamber 106 and flow this fluid to the chamber 202. Receptacle 204 and chamber 202 may be integral portions of a single sump 200 component, or may be separate portions that are connected to form the sump 200. The receptacle 204 may thus be an upper receptacle positioned above the lower chamber 202 along the vertical direction V. Receptacle may have a generally conical or funnel shape which directs the fluid flow towards and into the chamber 202, or may have any other suitable shape.

Figure 6:
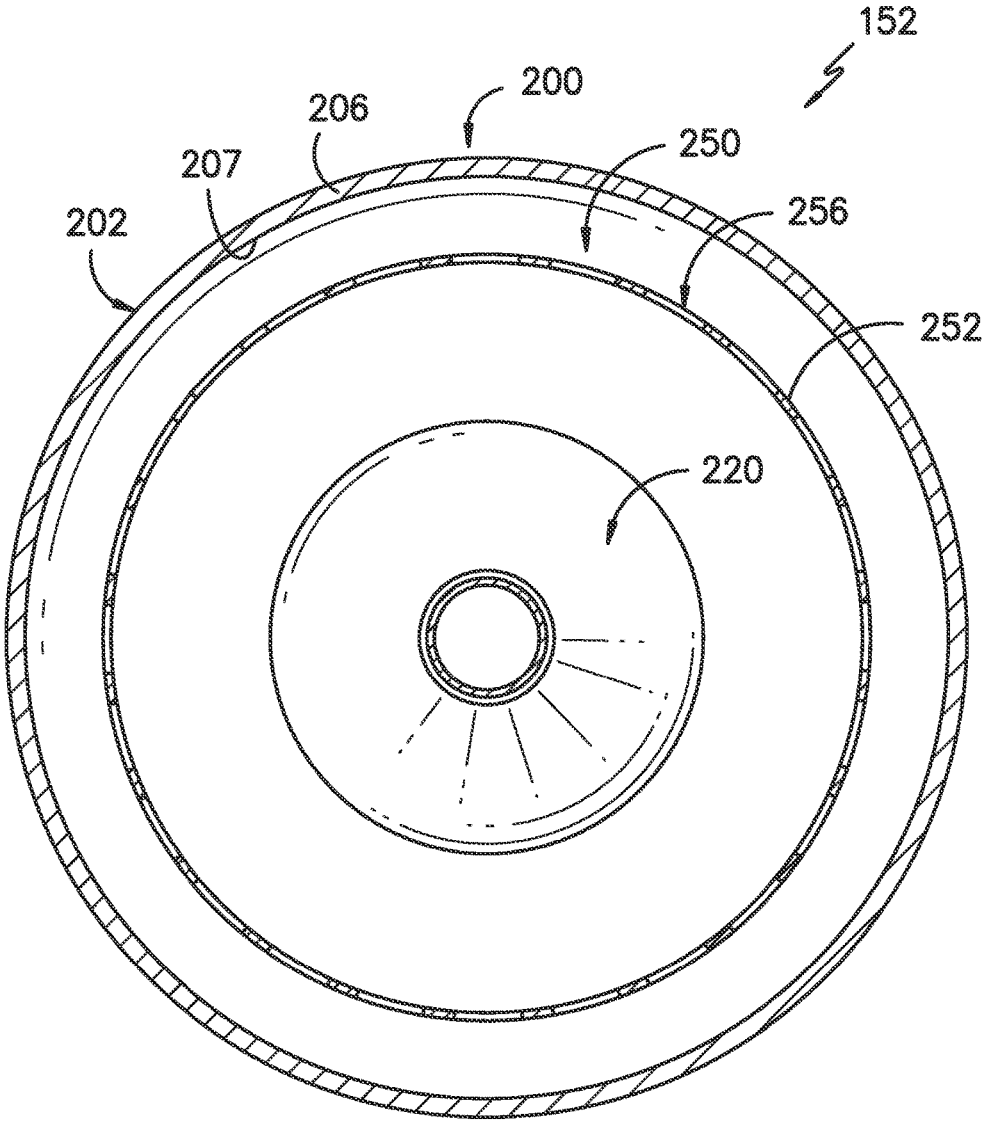
FIG. 6 provides a top, cross-sectional view of a fluid circulation system for a dishwasher appliance in accordance with another embodiment of the present disclosure.

As illustrated, chamber 202 may include a sidewall 206 and a base wall 208. The sidewall 206 may extend from the base wall 208. In some embodiments, the sidewall 206 may have a generally circular cross-sectional shape, as illustrated in FIG. 6. Alternatively, the sidewall 206 may have a generally rectangular or other suitable polygonal cross-sectional shape, with multiple linear or curvilinear cross-sectional portions.

System 152 may further include a pump 210. Pump 210 may include an impeller 212 which is disposed within the chamber 202. Pump 210 may further include a motor 214 and a shaft 216 which connects the motor 214 and impeller 212. As illustrated, the shaft 216 may extend through the base wall 208, and the motor 214 may be external to the chamber 202. Alternatively, the motor 214 may be disposed within the chamber 202, and may for example be hermetically sealed to prevent damage thereto from fluids within the chamber 202. Impeller 212 may spin within the chamber 202 when activated by the motor 214 to influence the flow of fluid within the chamber 202. Pump 210 may further include a diffuser 218. Diffuser 218 may receive fluid influenced by the impeller 212. Fluid may thus flow through the diffuser 218 and exit the pump 210 through the diffuser 218.

System 152 may further include an outlet conduit 220. The outlet conduit 220 flows fluid from the sump 200, such as from the chamber 202 thereof, to the wash chamber 106. For example, outlet conduit 220 may be connected to and in fluid communication with the various spray assemblies, such as the lower and mid-level spray-arm assemblies 144, 148 and the upper spray assembly 150, such that fluid flowed into the outlet conduit 220 can flow to these spray assemblies. Valves (not shown) disposed within the outlet conduit 220 or other conduits in the system 152 may selectively direct the flow of fluid from the outlet conduit 220 as required. Outlet conduit 220 may further be connected to and in fluid communication with the diffuser 218. Accordingly, fluid drawn into the diffuser 218 from the impeller 212 may flow from the diffuser 218 into the outlet conduit 220 towards, for example, the spray assemblies, drain assembly, etc.

As illustrated in FIGS. 3 through 7, a filter 250 is disposed within the chamber 202. As shown, the filter 250 surrounds the impeller 212, and can additionally surround at least a portion of the diffuser 218 as well as other components of the pump 210. Filters 250 and the configuration of filters 250 within chambers 202 in accordance with the present disclosure advantageously provide numerous advantages to the dishwasher appliance 100. In particular, fluid circulation systems 152 which include such components and configurations provide improved fluid filtering. Filters 250 and the configurations within chambers 250 advantageously respond to differences in soil conditions during operation, thus reducing the risk of clogging and providing more efficient filtering. Additionally, such filters 250 are advantageously passive filters, with no active elements such as cleaning jets, thus reducing the energy requirements and cost associated with such efficient filtering.

As illustrated, a filter 250 in accordance with the present disclosure may include a sidewall 252. Filter 250 may further include a top wall 254, through which the outlet conduit 220 extends. Still further, filter 250 may include a base wall (not shown) that contacts the base wall 208 of the chamber 202, or the sidewall 252 may contact the base wall 208. The sidewall 252 may extend from the top wall 254 or between the top wall 254 and bottom wall. In some embodiments, the sidewall 252 may have a generally circular cross-sectional shape, as illustrated in FIG. 6. Alternatively, the sidewall 252 may have a generally rectangular or other suitable polygonal cross-sectional shape, with multiple linear or curvilinear cross-sectional portions.

As further illustrated, the sidewall 252, as well as the top wall 254 and bottom wall, may define a plurality of perforations 256 extending therethrough. The perforations 256 may, as discussed herein, be sized and shaped to allow fluid flow therethrough, while preventing the flow of soil therethrough, thus filtering the fluid as it flows into the filter 250 through the walls thereof. Each perforation 256 may have any suitable shape, such as a generally circular cross-sectional shape, a generally rectangular cross-sectional shape, or other suitable polygonal cross-sectional shape. In the embodiments shown, the perforations are assumed to have circular cross-sectional shapes and thus be cylindrical.

Figure 3:
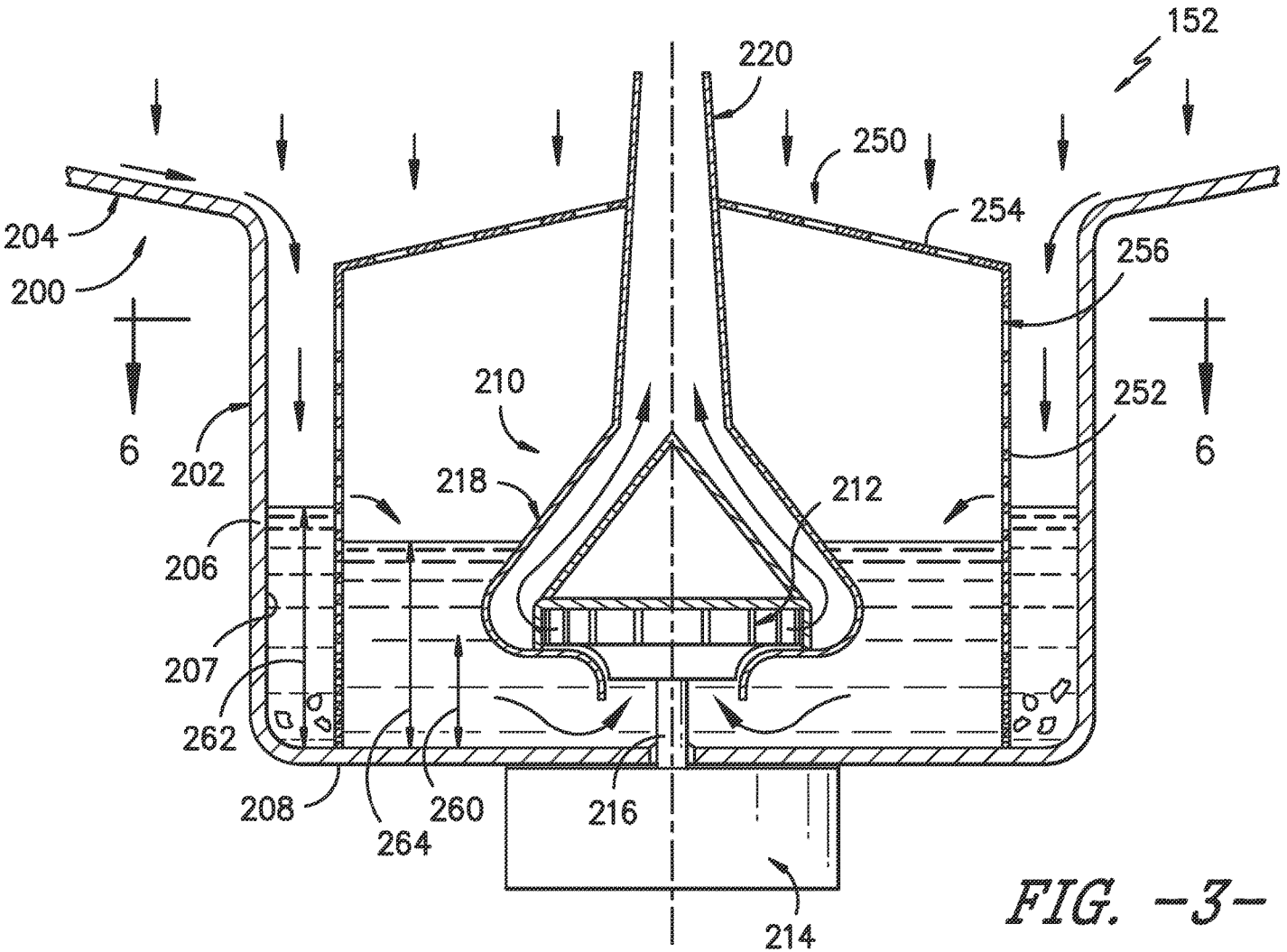
FIG. 3 provides a side, cross-sectional view of a fluid circulation system for a dishwasher appliance during a low soil condition in accordance with one embodiment of the present disclosure.
Figure 5:
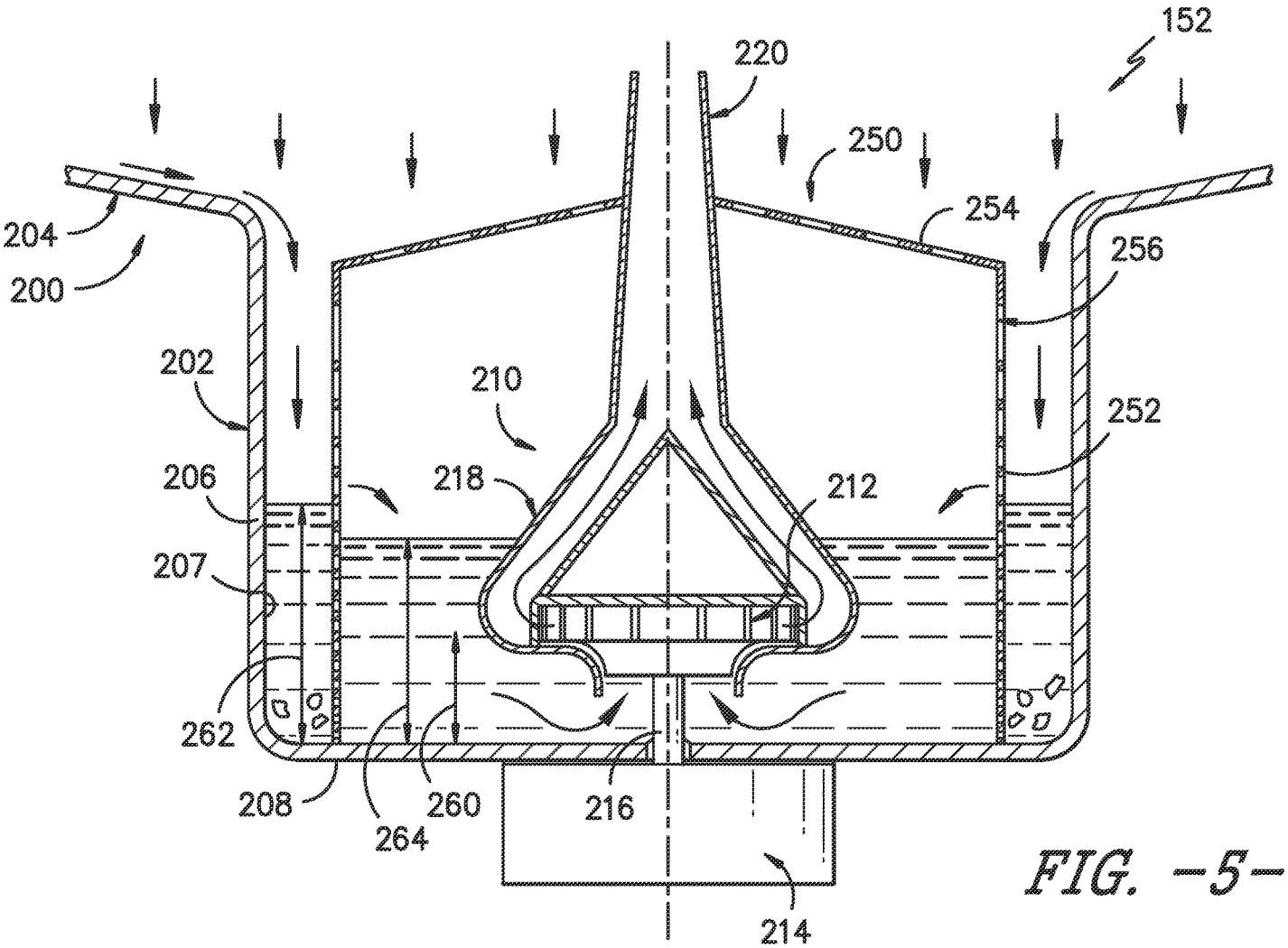
FIG. 5 provides a side, cross-sectional view of a fluid circulation system for a dishwasher appliance during a low soil condition in accordance with another embodiment of the present disclosure.
Figure 7:
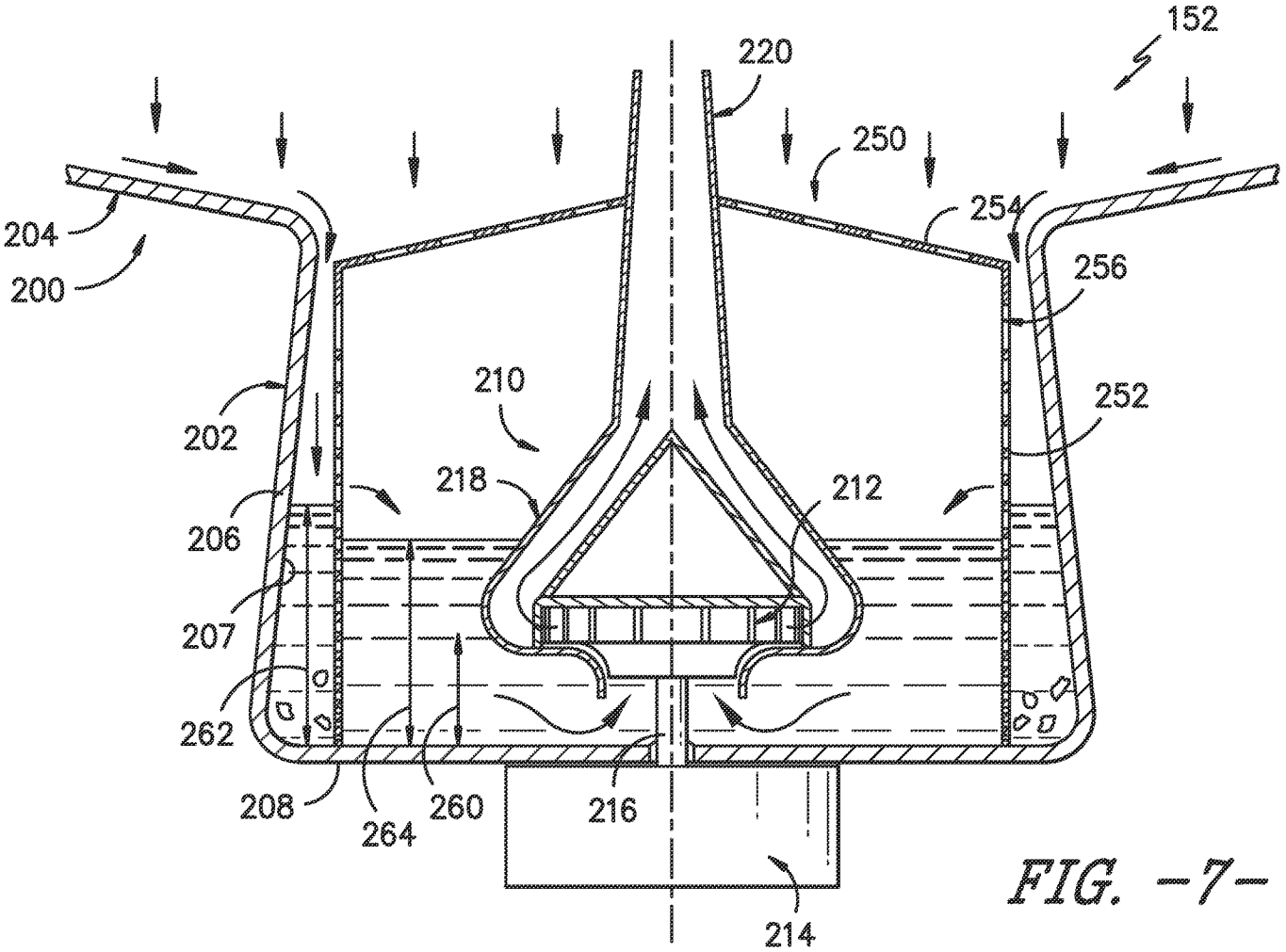
FIG. 7 provides a side, cross-sectional view of a fluid circulation system for a dishwasher appliance during a low soil condition in accordance with yet another embodiment of the present disclosure.

In some exemplary embodiments, as shown, a volume within the filter 250 is greater than a volume between the sidewall 206 of the chamber 202 and the sidewall 252 of the filter 250 for a given height 260 from the base wall 208. In other words, at any given height 260 from the base wall 208 (through which the sidewall 206 and sidewall 252 extend), the volume within the filter 250 is greater than the volume without the filter 250 (between the filter sidewall 252 and chamber sidewall 206). Advantageously, such arrangement allows the filter 250 to respond to differences in soil conditions in order to reducing clogging thereof. For example, FIGS. 3, 5 and 7 illustrate fluid flowing into filter 250, with the fluid having a low soil condition. In a low soil condition, the amount and/or size of soil particles is generally less relative to a high soil condition. Due to the disparity in volumes inside and outside of the filter 250, the height 262 (from base wall 208) of the fluid level outside of the filter 250 is greater than the height 264 (from base wall 208) of the fluid level inside of the filter 250. However, this disparity in heights 262, 264 is relatively minimal. In any event, the greater height 262 allows fluid to access additional, higher perforations in the sidewall 252, thus providing improved filtering and reducing clogging.

Figure 4:
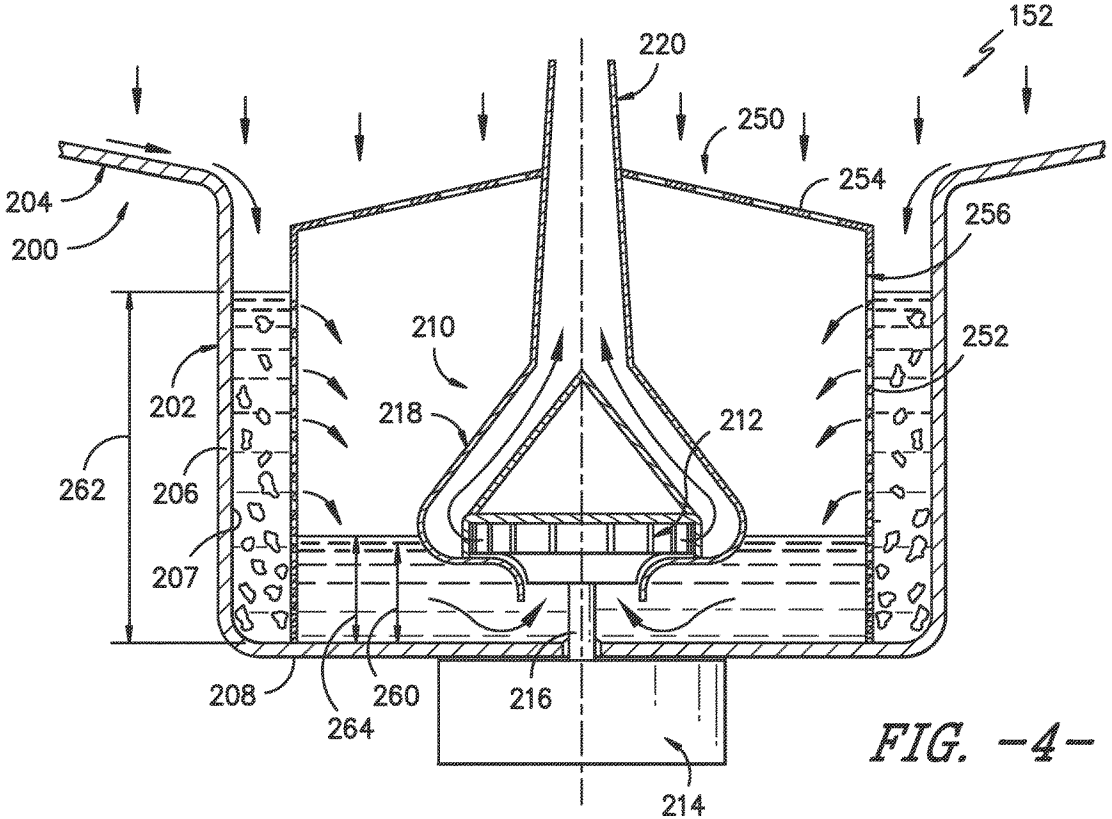
FIG. 4 provides a side, cross-sectional view of a fluid circulation system for a dishwasher appliance during a high soil condition in accordance with one embodiment of the present disclosure.

FIG. 4 illustrates fluid flowing into filter 250, with the fluid having a high soil condition. In a high soil condition, the amount and/or size of soil particles is generally greater relative to a low soil condition. Due to the disparity in volumes inside and outside of the filter 250, the height 262 (from base wall 208) of the fluid level outside of the filter 250 is greater than the height 264 (from base wall 208) of the fluid level inside of the filter 250. Further, this disparity in heights 262, 264 is greater than the disparity during a low soil condition. The greater height 262 and increased disparity in heights 262, 264 allows fluid to access even more additional, higher perforations in the sidewall 252, thus providing improved filtering and reducing clogging. The disparity in volumes thus allows the passive filter 250 to respond to varying soil conditions, by facilitating disparities in heights during high soil conditions versus low soil conditions to allow additional access to perforations 256 as required, thus providing improved filtering and reducing clogging.

In some embodiments, as illustrated in FIGS. 3 through 5, the sidewall 206 of the chamber 202 extends from the base wall 208 along the vertical direction V. The sidewall 252 of the filter 250 may additionally extend along the vertical direction V. The sidewalls 206, 252 in these or other embodiments may thus be generally parallel.

In other embodiments, as illustrated in FIG. 7, at least a portion of the inner surface 207 of the sidewall 206 of the chamber 202 extends from the base wall 208 at an angle to the vertical direction V. As illustrated, the portion of the inner surface 207 may extend from the base wall 208 inward towards the filter 250, such as towards the sidewall 252. The sidewall 252 of the filter 250 may extend along the vertical direction V. At least portions of the sidewalls 206, 252 in these or other embodiments may thus not be parallel. In embodiments wherein a portion of the inner surface 207 extends inwards towards the filter 250, this facilitate a faster increase in the disparity between the heights 262, 264 as the soil condition and fluid height increases, by reducing the outer volume as the height 260 increases.

In additional or alternative embodiments, the perforations 256 may advantageously be configured to facilitate improved filtration and reduced clogging. For example, and referring to FIGS. 3 through 5 and 7, the volumes of the perforations 256 may increase along the height 260 from the base wall 208. In other words, as the height 260 increases, the volumes of the individual perforations 256 may increase. The increase in volumes in correspondence with increasing height 260 may be advantageous for further reducing clogging and improving filtration. For example, as discussed above, higher soil conditions result in increased heights 262 of fluid outside of the filter 250. Fluid at higher heights 262, however, can advantageously flow easier through the larger volume perforations 256, with larger soil particles still being filtered by such perforations 256. Accordingly, the risks of clogging during high soil conditions can advantageously be minimized, and filtration thus improved.

In some embodiments, as illustrated in FIGS. 3, 4 and 7, the increase in volume of the perforations 256 may be step-wise. In a step-wise increase, a number of rows of perforation 256 and/or perforations 256 in a given height range have generally identical volumes. A neighboring number of rows of perforation 256 and/or perforations 256 in a next height range have generally identical volumes which are greater than the first, and so on. In other embodiments, as illustrated in FIG. 5, the increase in volume of the perforations 256 may be continuous. In a continuous increase, each perforation 256 is greater in volume than the perforation directly below it along the height 260 and less in volume than the perforation directly above it along the height 260. The perforations 256 can be arranged in rows, with each row of perforations 256 increasing in volume relative to the row below it along the height 260.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A fluid circulation system for a dishwasher appliance, the dishwasher appliance defining a vertical direction, a lateral direction, and a transverse direction which are mutually orthogonal, the dishwasher appliance comprising a tub that defines a wash chamber, the fluid circulation system comprising:

a sump positioned below the wash chamber along the vertical direction for receiving fluid from the wash chamber, the sump comprising a chamber having a sidewall and a base wall;

a pump, the pump comprising an impeller disposed within the chamber; and a filter disposed within the chamber and surrounding the impeller, the filter comprising a sidewall extending along the vertical direction between the base wall of the chamber and a top wall of the filter, the sidewall of the filter spaced from the sidewall of the chamber and radially aligned with the impeller, the sidewall of the filter defining a plurality of perforations extending therethrough, individual volumes of each of the plurality of perforations increasing along the vertical direction from the base wall of the chamber;

wherein a volume within the filter is greater than a volume between the sidewall of the chamber and the sidewall of the filter at any given height from the base wall.

2. The fluid circulation system of claim 1, wherein the increase is continuous.

3. The fluid circulation system of claim 1, wherein the increase is step-wise.

4. The fluid circulation system of claim 1, wherein the sidewall of the chamber extends from the base wall along the vertical direction.

5. The fluid circulation system of claim 1, wherein at least a portion of an inner surface of the sidewall of the chamber extends from the base wall at an angle to the vertical direction.

6. The fluid circulation system of claim 5, wherein the portion of the inner surface extends from the base wall inward towards filter.

7. The fluid circulation system of claim 1, wherein the sump further comprises an upper receptacle for receiving the fluid and flowing the fluid to the chamber.

8. The fluid circulation system of claim 1, further comprising an outlet conduit in fluid communication with a diffuser of the pump.

9. The fluid circulation system of claim 1, wherein the pump further comprises a motor disposed external to the sump and a shaft extending through the base wall of the chamber, the shaft connecting the motor and the impeller.

10. A fluid circulation system for a dishwasher appliance, the dishwasher appliance defining a vertical direction and comprising a tub that defines a wash chamber, the fluid circulation system comprising:

a sump positioned below the wash chamber along the vertical direction for receiving fluid from the wash chamber, the sump comprising a chamber having a sidewall and a base wall;

a pump, the pump comprising an impeller disposed within the chamber; and a filter disposed within the chamber and surrounding the impeller, the filter comprising a sidewall extending along the vertical direction between the base wall of the chamber and a top wall of the filter, the sidewall of the filter spaced from the sidewall of the chamber and radially aligned with the impeller, the sidewall of the filter defining a plurality of perforations extending therethrough, wherein individual volumes of each of the plurality of perforations increase along the vertical direction from the base wall.

11. The fluid circulation system of claim 10, wherein the increase is continuous.

12. The fluid circulation system of claim 10, wherein the increase is step-wise.

13. The fluid circulation system of claim 10, wherein the dishwasher appliance defines a vertical direction, and wherein the sidewall of the chamber extends from the base wall along the vertical direction.

14. The fluid circulation system of claim 10, wherein the dishwasher appliance defines a vertical direction, and wherein at least a portion of an inner surface of the sidewall of the chamber extends from the base wall at an angle to the vertical direction.

15. The fluid circulation system of claim 14, wherein the portion of the inner surface extends from the base wall inward towards filter.

16. The fluid circulation system of claim 10, wherein the sump further comprises an upper receptacle for receiving the fluid and flowing the fluid to the chamber.

17. The fluid circulation system of claim 10, further comprising an outlet conduit in fluid communication with a diffuser of the pump.

18. The fluid circulation system of claim 10, wherein the pump further comprises a motor disposed external to the sump and a shaft extending through the base wall of the chamber, the shaft connecting the motor and the impeller.

* * * * *